US011859457B2

(12) United States Patent
Rowaihy et al.

(10) Patent No.: US 11,859,457 B2
(45) Date of Patent: Jan. 2, 2024

(54) ACCESSING LATERAL WELLBORES IN A MULTILATERAL WELL

(71) Applicant: Saudi Arabian Oil Company, Dhahran (SA)

(72) Inventors: Feras Hamid Rowaihy, Dhahran (SA); Carl D. Lindahl, Dhahran (SA); Suresh Jacob, Dhahran (SA); Ahmed A. Al Sulaiman, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 17 days.

(21) Appl. No.: 17/540,572

(22) Filed: Dec. 2, 2021

(65) Prior Publication Data

US 2023/0175331 A1 Jun. 8, 2023

(51) Int. Cl.
*E21B 23/03* (2006.01)
*E21B 41/00* (2006.01)

(52) U.S. Cl.
CPC ..... *E21B 23/03* (2013.01); *E21B 41/0035* (2013.01)

(58) Field of Classification Search
CPC ..... E21B 41/0035
See application file for complete search history.

(56) References Cited

U.S. PATENT DOCUMENTS 2,797,894 A * 7/1957 Meyer ..... E21B 7/061 166/117.5
3,354,961 A 11/1967 Pennington
5,311,936 A 5/1994 McNair et al.
5,322,127 A * 6/1994 McNair ..... E21B 43/103 166/117.6
6,012,527 A * 1/2000 Nitis ..... E21B 7/061 166/50

(Continued)

FOREIGN PATENT DOCUMENTS

CA 2802988 12/2011
GB 2293186 3/1996

(Continued)

OTHER PUBLICATIONS

Abubaker et al., "Technology Trial Review: Selective Coiled Tubing Re-Entry of Two Open Hole Multilateral Wells Using Intelligent Electromechanical Arm," SPE-182996-MS, Society of Petroleum Engineers (SPE), presented at the Abu Dhabi International Petroleum Exhibition & Conference, Abu Dhabi, UAE, Nov. 7-10, 2016, 14 pages.

(Continued)

*Primary Examiner* — Jonathan Malikasim
(74) *Attorney, Agent, or Firm* — Fish & Richardson P.C.

(57) ABSTRACT

A wellbore whipstock tool assembly includes a body that includes an uphole axial surface that is slanted from one portion of an edge of the uphole axial surface to another portion of the edge of the uphole axial surface, a downhole axial surface opposite the uphole axial surface, and a radial surface between the uphole axial surface and the downhole axial surface; one or more keys formed on the radial surface and configured to secure into one or more keyholes formed in a casing of a wellbore; and a bore that extends between an opening in the uphole axial surface and an opening in the downhole axial surface, the bore sized to receive a bottom hole assembly of an intervention tool.

30 Claims, 7 Drawing Sheets

(56) References Cited

U.S. PATENT DOCUMENTS

| | | | | |
|---|---|---|---|---|
| 6,192,748 | B1 * | 2/2001 | Miller | E21B 47/022 73/152.43 |
| 7,090,022 | B2 * | 8/2006 | Smith | E21B 43/103 313/50 |
| 9,506,325 | B2 | 11/2016 | Fould et al. | |
| 9,617,829 | B2 * | 4/2017 | Dale | E21B 43/14 |
| 10,563,483 | B2 | 2/2020 | Steele | |
| 10,590,741 | B2 | 3/2020 | Van Der Veen et al. | |
| 10,731,417 | B2 * | 8/2020 | Vemuri | E21B 29/06 |
| 11,486,231 | B1 | 11/2022 | Rowaihy et al. | |
| 11,578,567 | B1 | 2/2023 | Rowaihy et al. | |
| 2003/0192717 | A1 | 10/2003 | Smith | |
| 2004/0055752 | A1 | 3/2004 | Restarick | |
| 2015/0226042 | A1 | 8/2015 | Barker | |
| 2015/0315850 | A1 | 11/2015 | Hallundbaek | |
| 2016/0145956 | A1 | 5/2016 | Dahl | |
| 2018/0274300 | A1 | 9/2018 | Vemuri et al. | |
| 2019/0040719 | A1 | 2/2019 | Rodriguez | |
| 2020/0256128 | A1 | 8/2020 | Cho | |
| 2020/0256129 | A1 | 8/2020 | Kuhlman | |
| 2021/0010350 | A1 | 1/2021 | Steele | |
| 2023/0024404 | A1 | 1/2023 | Rowaihy et al. | |

FOREIGN PATENT DOCUMENTS

| | | |
|---|---|---|
| WO | WO 2013044300 | 4/2013 |
| WO | WO 2018111103 | 6/2018 |
| WO | WO 2019099038 | 5/2019 |

OTHER PUBLICATIONS

Al-Khaldy et al., "First-Ever Level 4 Multilateral Well in North Kuwait Successfully Completed, Improves Oil Production," SPE-171792-MS, Society of Petroleum Engineers (SPE), presented at the Abu Dhabi International Petroleum Exhibition and Conference, Abu Dhabi, UAE, Nov. 10-13, 2014, 12 pages.

Aruhke et al., "Technology Evolution in a Giant Saudi Aramco's Field Development," WPC-21-0182, Work Petroleum Congress (WPC), presented at the 21st World Petroleum Congress, Moscow, Russia, Jun. 2014, 17 pages.

Halliburton, "IsoRite Isolated Multilateral Completion Systems: For multilateral wells that require re-entry capability to access the lateral," 2018, 3 pages.

Saeed et al., "Multilateral Reentry System for Well Surveillance: Design, Implementation and Summary of 40 Jobs Performed in Fields," SPE-199849-MS, Society of Petroleum Engineers (SPE), presented at the SPE/ICoTA Well Intervention Conference and Exhibition, The Woodlands, Texas, Mar. 24-25, 2020, 9 pages.

Schlumberger, "Discovery MLT: Multilateral reentry system," 2021, 3 pages.

Schlumberger, "SLIC: Selective lateral intervention completion system," 2019, 2 pages.

PCT International Search Report and Written Opinion in International Appln. No. PCT/US2022/073893, dated Nov. 2, 2022, 14 pages.

PCT International Search Report and Written Opinion in International Appln. No. PCT/US2022/073900, dated Oct. 31, 2022, 14 pages.

* cited by examiner

ACCESSING LATERAL WELLBORES IN A MULTILATERAL WELL

TECHNICAL FIELD

The present disclosure describes systems and method for accessing one or more lateral wellbore in a multilateral well with one or more whipstocks.

BACKGROUND

Accessing several laterals in a multilateral well for rigless intervention operations can provide for more efficient production of hydrocarbon fluids from a single, vertical well. Conventionally, accessing multiple, different laterals within a multilateral well for intervention operations requires a drilling rig and may not allow for selective production from each of the multiple laterals.

SUMMARY

In an example implementation, a wellbore intervention system includes a first whipstock configured to run into a wellbore formed from a terranean surface to one or more subterranean formations. The first whipstock includes a first bore of a first diameter that extends from an uphole, angled face of the first whipstock to a downhole face of the first whipstock, and one or more first keys formed on a radial exterior surface of the first whipstock and configured to secure into one or more first keyholes formed in a casing that is secured in the wellbore to position the first whipstock adjacent a first lateral formed from a first lateral window in the casing. The system includes a second whipstock configured to run into the wellbore formed from a terranean surface to one or more subterranean formations. The second whipstock includes a second bore of a second diameter that extends from an uphole, angled face of the second whipstock to a downhole face of the second whipstock, and one or more second keys formed on a radial exterior surface of the second whipstock and configured to secure into one or more second keyholes formed in the casing to position the second whipstock adjacent a second lateral formed from a second lateral window in the casing. The system includes an intervention tool configured to selectively pass through one or both of the first or second bores and enter at least one of the first lateral, the second lateral, or another lateral downhole of the first and second laterals.

In an aspect combinable with the example implementation, the one or more first keys include a first geometric configuration unique to the one or more first keyholes, and the one or more second keys include a second geometric configuration unique to the one or more second keyholes.

In another aspect combinable with any of the previous aspects, the first diameter is less than the second diameter, and the second lateral window is uphole of the first lateral window.

In another aspect combinable with any of the previous aspects, the one or more first keys are positioned on the first whipstock to engage the one or more first keyholes to orient the uphole, angled face of the first whipstock angularly downward toward the first lateral window.

In another aspect combinable with any of the previous aspects, the one or more second keys are positioned on the second whipstock to engage the one or more second keyholes to orient the uphole, angled face of the second whipstock angularly downward toward the second lateral window.

Another aspect combinable with any of the previous aspects further includes a retrievable plug configured to position within at least a portion of the first bore and flush with the uphole, angled face of the first whipstock to fluidly separate a portion of the wellbore uphole of the first whipstock from a portion of the wellbore downhole of the first whipstock.

Another aspect combinable with any of the previous aspects further includes a retrievable entry guide configured to position within at least a portion of the first bore, the guide including a funnel or conical shape to guide a bottom hole assembly of the intervention tool into the first bore.

In another aspect combinable with any of the previous aspects, the first whipstock further includes one or more magnets positioned at or adjacent the uphole, angled face of the first whipstock, the one or more magnets configured to attract a bottom hole assembly of the intervention tool toward an uphole side of the uphole, angled face of the first whipstock such that the bottom hole assembly of the intervention tool can slide into the first bore from the uphole side of the uphole, angled face of the first whipstock based on a setting down weight of a workstring on the intervention tool.

In another aspect combinable with any of the previous aspects, the first whipstock further includes one or more magnets positioned within a body of the first whipstock adjacent or near the first bore, the one or more magnets configured to attract a bottom hole assembly of the intervention tool toward and through the first bore.

In another aspect combinable with any of the previous aspects, the first whipstock further includes at least one sensor configured to detect the intervention tool passing through the first bore.

In another aspect combinable with any of the previous aspects, the first diameter is the same or substantially the same as the second diameter.

Another aspect combinable with any of the previous aspects further includes an adjustable entry tool configured to adjust between a closed position to pass into the first bore and prevent passage of the intervention tool through the first bore, and an open position, based on a signal from the terranean surface, to allow passage of the intervention tool through the first bore while the entry tool is positioned in the first bore.

In another aspect combinable with any of the previous aspects, the intervention tool is configured to perform one or more well intervention operations in the first lateral, the second lateral, or the another lateral downhole of the first and second laterals after passing through at least one of the first or second bores.

In another example implementation, a well intervention method includes running a first whipstock into a wellbore formed from a terranean surface to one or more subterranean formations, the first whipstock including a first bore of a first diameter that extends from an uphole, angled face of the first whipstock to a downhole face of the first whipstock; securing the first whipstock into a casing installed in the wellbore by securing one or more first keys formed on a radial exterior surface of the first whipstock into one or more first keyholes formed in the casing; based on the securing, positioning the first whipstock adjacent a first lateral formed from a first lateral window in the casing; running a second whipstock into the wellbore, the second whipstock including a second bore of a second diameter that extends from an uphole, angled face of the second whipstock to a downhole face of the second whipstock; securing the second whipstock into the casing by securing one or more second keys formed on a radial exterior surface of the second whipstock into one or more second keyholes formed in the casing; based on the securing, positioning the second whipstock adjacent a second lateral formed from a second lateral window in the casing; and selectively passing an intervention tool run into the wellbore through one or both of the first or second bores; and running the intervention tool into at least one of the first lateral, the second lateral, or another lateral downhole of the first and second laterals subsequent to selectively passing the intervention tool through the one or both of the first or second bores.

In an aspect combinable with the example implementation, the one or more first keys include a first geometric configuration unique to the one or more first keyholes, and the one or more second keys include a second geometric configuration unique to the one or more second keyholes.

In another aspect combinable with any of the previous aspects, the first diameter is larger than the second diameter, and the second lateral window is downhole of the first lateral window.

Another aspect combinable with any of the previous aspects further includes engaging the one or more first keys with the one or more first keyholes to orient the uphole, angled face of the first whipstock angularly downward toward the first lateral window; and engaging the one or more second keys with the one or more second keyholes to orient the uphole, angled face of the second whipstock angularly downward toward the first lateral window.

Another aspect combinable with any of the previous aspects further includes positioning a retrievable plug within at least a portion of the first bore and flush with the uphole, angled face of the first whipstock; fluidly separating a portion of the wellbore uphole of the first whipstock from a portion of the wellbore downhole of the first whipstock through the first bore with the retrievable plug positioned within the portion of the first bore; and subsequent to positioning the retrievable plug, running the intervention tool into the first lateral from the first lateral window.

Another aspect combinable with any of the previous aspects further includes positioning a retrievable entry guide within at least a portion of the first bore; and guiding, with the retrievable entry guide positioned in the portion of the first bore, a bottom hole assembly of the intervention tool into the first bore.

Another aspect combinable with any of the previous aspects further includes attracting a bottom hole assembly of the intervention tool toward an uphole side of the uphole, angled face of the first whipstock with one or more magnets positioned at or adjacent the uphole, angled face of the first whipstock; setting down weight on the intervention tool with a workstring; and based on the weight, sliding the intervention tool into the first bore from an uphole side of the uphole, angled face of the first whipstock.

Another aspect combinable with any of the previous aspects further includes attracting a bottom hole assembly of the intervention tool toward and through the first bore with one or more magnets positioned within a body of the first whipstock adjacent or near the first bore.

Another aspect combinable with any of the previous aspects further includes detecting the intervention tool passing through the first bore of the first whipstock with at least one sensor positioned in the first whipstock.

In another aspect combinable with any of the previous aspects, the first diameter is the same or substantially the same as the second diameter.

Another aspect combinable with any of the previous aspects further includes running an adjustable entry tool into the wellbore in a closed position; positioning the adjustable entry tool in the first bore; adjusting the adjustable entry tool from the closed position to an open position; and running the intervention tool through the first bore and into the second lateral through the second lateral window.

Another aspect combinable with any of the previous aspects further includes performing one or more well intervention operations in the first lateral, the second lateral, or the another lateral downhole of the first and second laterals with the intervention tool after passing through at least one of the first or second bores.

In another example implementation, a wellbore whipstock tool assembly includes a body that includes an uphole axial surface that is slanted from one portion of an edge of the uphole axial surface to another portion of the edge of the uphole axial surface, a downhole axial surface opposite the uphole axial surface, and a radial surface between the uphole axial surface and the downhole axial surface; one or more keys formed on the radial surface and configured to secure into one or more keyholes formed in a casing of a wellbore; and a bore that extends between an opening in the uphole axial surface and an opening in the downhole axial surface, the bore sized to receive a bottom hole assembly of an intervention tool.

In an aspect combinable with the example implementation, the one or more keys are configured to uniquely fit within the one or more keyholes.

In another aspect combinable with any of the previous aspects, the one or more keys are positioned on the radial surface to engage the one or more keyholes to orient the body such that the portion of the edge of the uphole axial surface is uphole of the another portion of the edge of the uphole axial surface, and the another portion of the edge of the uphole axial surface is adjacent to a lateral window of the casing.

Another aspect combinable with any of the previous aspects further includes a retrievable plug configured to position within at least a portion of the bore and flush with the uphole axial surface.

Another aspect combinable with any of the previous aspects further includes a retrievable entry guide configured to position within at least a portion of the bore, the guide including a funnel or conical shape to guide a bottom hole assembly of the intervention tool into the bore.

Another aspect combinable with any of the previous aspects further includes one or more magnets positioned at or adjacent the uphole axial surface of the body, the one or more magnets configured to attract a bottom hole assembly of the intervention tool toward the portion of the edge of the uphole axial surface.

Another aspect combinable with any of the previous aspects further includes one or more magnets positioned within the body adjacent or near the bore, the one or more magnets configured to attract a bottom hole assembly of the intervention tool toward and through the bore.

Another aspect combinable with any of the previous aspects further includes at least one sensor positioned in the body and configured to detect the intervention tool passing through the bore.

Implementations of a well intervention system according to the present disclosure may include one or more of the following features. For example, a well intervention system according to the present disclosure can include one or more whipstocks that selective allow fluids and/or an intervention tool to pass through a bore formed therein. Also, a well intervention system according to the present disclosure can reduce a cost of well intervention and can increase well productivity and monitoring and control of segments inside laterals. Also, a well intervention system according to the present disclosure can facilitate rigless, selective intervention in a designated lateral of a multilateral well while also allowing selective production from other laterals in the well.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
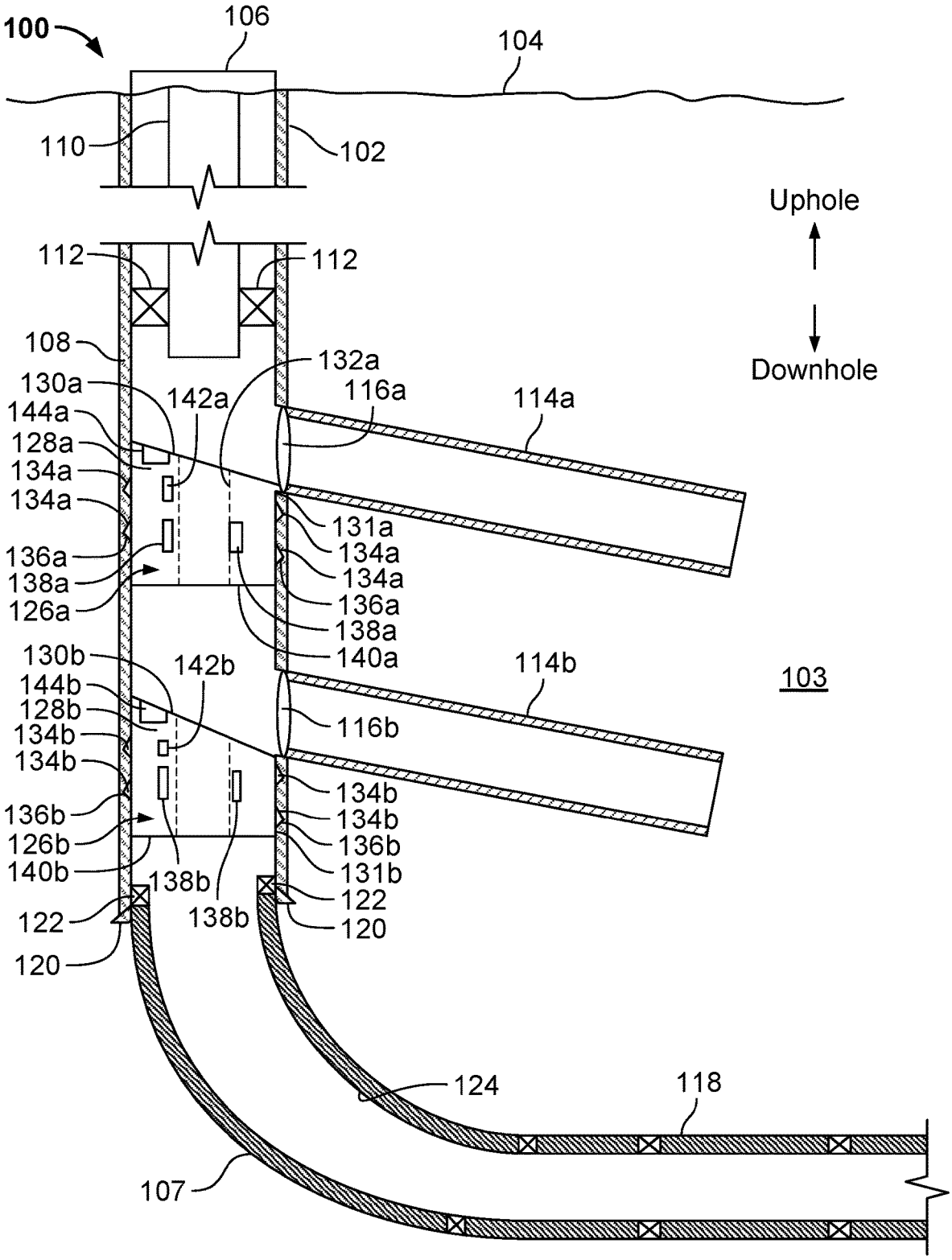
FIGS. 1-5 are schematic diagrams of an example implementation of a wellbore intervention system that includes one or more whipstocks during one or more intervention operations according to the present disclosure.

FIGS. 1-5 are schematic diagrams of an example implementation of a wellbore intervention system 100 that includes one or more whipstocks 126*a*-126*b* during one or more intervention operations according to the present disclosure. Generally, FIGS. 1-5 illustrate wellbore intervention system 100 that includes aspects of wellbore construction and well completion accessories that allow rigless (for example, intervention without a drilling or workover rig) and through-tubing intervention operations into multiple laterals of a multilateral wellbore. In some aspects, wellbore intervention system 100 simplifies well completion methodologies while increasing monitoring and control of segments inside laterals of a multilateral wellbore. As described in more detail here, the wellbore intervention system 100 includes one or more whipstocks 126*a* and 126*b*; in alternative implementations, wellbore intervention system 100 can include a single whipstock or more than two whipstocks according to the present disclosure. The illustrated whipstocks 126*a* and 126*b* can include orientation profiles (for example, one or more keys) that match or fit within orientation profiles (for example, one or more keyholes) that are run as part of a casing (or other wellbore tubular, such as a liner) and cemented in place in the wellbore. Further, the illustrated whipstocks 126*a* and 126*b* can each include a bypass port with an opening on a whipstock face to allow a tool string (for example, with a smaller outer diameter (OD) than a diameter of the bore) to pass through to a next whipstock.

In some example implementations, the wellbore intervention system 100 can include a temporary (for example, retrievable) plug that can be installed in a bypass port of a whipstock to close the bypass port and allow intervention into a lateral wellbore at the whipstock. In some aspects, the plug can also act as a pressure sealing element for pressure isolation (for example, fluid decoupling) between laterals. Thus, the example implementations of the whipstocks 126*a*-126*b* can be used for selective access different laterals for intervention operations, while also allowing selective production from one, some, or all of the laterals in a multilateral well.

As illustrated, wellbore intervention system 100 includes a wellbore 102 formed from a terranean surface 104 into and through one or more subterranean formations 103 for the purpose of producing hydrocarbon fluids (for example, oil, gas, or both) or other fluids. In this example implementation, the wellbore intervention system 100 is a rigless system that includes a wellhead 106 at the terranean surface 104 to allow access to the wellbore 102. Although labeled as a terranean surface 104, this surface may be any appropriate surface on Earth (or other planet) from which drilling and completion equipment may be staged to recover hydrocarbons from a subterranean zone. For example, in some aspects, the surface 104 may represent a body of water, such as a sea, gulf, ocean, lake, or otherwise. In some aspects, all are part of the wellbore intervention system 100 may be staged on the body of water or on a floor of the body of water (for example, ocean or gulf floor). Thus, references to terranean surface 104 includes reference to bodies of water, terranean surfaces under bodies of water, as well as land locations.

Although illustrated as generally vertical portions and generally horizontal portions, such parts of the wellbore 102 may deviate from exactly vertical and exactly horizontal (for example, relative to the terranean surface 104) depending on the formation techniques of the particular wellbore 102, type of rock formation in the subterranean formation 103, and other factors. Generally, the present disclosure contemplates all conventional and novel techniques for forming the wellbore 102 from the surface 104 into the subterranean formation 103.

In this example, wellbore 102 includes a casing 108 that is secured (for example, cemented) in place in the wellbore 102 and extends from at or near the terranean surface 104 to at least a depth in which casing shoes 120 are installed. Although illustrated as a single casing 108, casing 108 can be comprised of multiple casings that, as depth increases, decrease in diameter. For example, casing 108 can include a surface casing, a conductor casing, an intermediate casing, and a production casing (or a combination of less than these casings). For simplicity, the combination of casings can be referred to as casing 108.

At or near the casing shoes 120 are positioned liner hangers 122 from which a wellbore liner 124 can be hung and extend into a horizontal 118 of the wellbore 102. In some examples, the liner 124 can also be secured (for example, cemented) into place in the wellbore 102. As shown in this example, horizontal 118 extends from a curved or transition portion 107 of the wellbore 102, which in turn extends from a vertical or near vertical portion of the wellbore 102.

As shown in this example implementation, a tubular (tubular string) 110, such as a production tubing 110, extends from at or near the terranean surface 104 into the wellbore 102. In this example, the production tubing 110 terminates uphole of the lateral 114*a*. One or more wellbore seals 112 (such as packers or other seals) are positioned in an annulus of the wellbore between the production tubing 110 and the casing 108. The one or more wellbore seals 112, once positioned and, in some cases, expanded to contact the tubing 110 and the casing 108, can fluidly decouple a portion of the annulus of the wellbore 102 that is downhole from the wellbore seal(s) 112 from a portion of the annulus of the wellbore 102 that is uphole from the wellbore seal(s) 112. Thus, any production fluid from the laterals 114*a* and 114*b* and the horizontal 118 can be circulated (for example, forcibly or naturally) uphole to the terranean surface 104 through the production tubing 110. Furthermore, as described in more detail here, one or more intervention tools (for example, positioned on a workstring such as regular or coiled tubing) can be run into the wellbore 102 through the production tubing 110 to selectively perform intervention operations in the laterals 114*a* and 114*b* and the horizontal 118 based on operation of the whipstocks 126*a* and 126*b*.

As illustrated in this example, laterals (or lateral wellbores) 114*a* and 114*b* extend (for example, horizontally or curved or slanted) from the wellbore 102. Although two laterals 114*a* and 114*b*, the present disclosure contemplates that fewer or more laterals can be formed from the wellbore 102. As shown, lateral 114*a* extends from the wellbore 102 at lateral casing window 116*a*, while lateral 114*b* extends from the wellbore 102 at lateral casing window 116*b*. Thus, in this example, three lateral wellbores—lateral 114*a*, lateral 114*b*, and horizontal 118—are shown. Components such as casings, liners, sleeves, inflow control devices, and other production control equipment can be placed in one, some, or all of the illustrated lateral wellbores.

As shown in FIG. 1, wellbore intervention system 100 includes whipstock 126*a* that, in this figure, is run into the wellbore 102 and secured to the casing 108 in a particular orientation. As shown, whipstock 126*a* includes a body 128*a* that can be generally cylindrical and has an uphole axial surface 130*a*, a downhole axial surface 140*a*, and a radial exterior surface 131*a*. In this example, the radial exterior surface 131*a* includes a profile 134*a* (also called keys 134*a*) that can be secured in corresponding keyholes 136*a* that are formed (for example, machined) in the inner surface of the casing 108. When the keys 134*a* mate with the keyholes 136*a*, the whipstock 126*a* is positioned adjacent and just downhole of the lateral casing window 116*a*.

As shown in this example, the uphole axial surface 130*a* is angled or slanted from a first edge portion of a top circumference to a second edge portion that is approximately 180° radially apart from the first edge portion. Thus, as shown, when the keys 134*a* mate with the keyholes 136*a*, the whipstock 126*a* is positioned such that the uphole axial surface 130*a* is angled downward toward the lateral casing window 116*a* (in other words, the first edge portion is slightly more uphole than the second edge portion).

As shown in FIG. 1, the whipstock 126*a* includes a bore 132*a* (for example, a cylindrical bore) that extends from the uphole axial surface 130*a* to the downhole axial surface 140*a*, thereby creating a flowpath through the whipstock 126*a*. As described in more detail herein, the bore 132*a* can be used as a flowpath for production fluids, a pass through for an intervention tool, or both, as needed.

In some aspects, and as shown in this example implementation, the whipstock 126*a* can include one or more magnets 138*a* that are positioned adjacent or near the bore 132*a* in the body 128*a* of the whipstock 126*a*. In some aspects, the magnets 138*a* (which can be permanent magnets, electromagnets, or other type of magnets) can attract a bottom hole assembly of an intervention tool to guide the tool through the bore 132*a* (when running into the wellbore 102 to, for example, the lateral 114*b*).

In further aspects, and as shown in this example implementation, the whipstock 126*a* can include a sensor 142*a* that is positioned adjacent or near the bore 132*a* in the body 128*a* of the whipstock 126*a*. In some aspects, the sensor 142*a* can detect (and send a signal to terranean surface 104 based on the detection) a presence of a bottom hole assembly of an intervention tool to guide the tool through the bore 132*a* (when running into the wellbore 102 to, for example, the lateral 114*b*).

In still further aspects, and as shown in this example implementation, the whipstock 126*a* can include one or more magnets 144*a* that are positioned adjacent or near the uphole axial surface 130*a* of the body 128*a* and, more particularly, near an uphole edge (in other words, the first edge portion) of the slanted surface 130*a* and away from the lateral casing window 116*a*. In some aspects, the magnets 144*a* (which can be permanent magnets, electromagnets, or other type of magnets) can attract a bottom hole assembly of an intervention tool to guide the tool through the bore 132*a* (when running into the wellbore 102 to, for example, the lateral 114*b*).

As also shown in FIG. 1, wellbore intervention system 100 also includes whipstock 126*b* that, in this figure, is run into the wellbore 102 and secured to the casing 108 in a particular orientation. As shown, whipstock 126*b* includes a body 128*b* that can be generally cylindrical and has an uphole axial surface 130*b*, a downhole axial surface 140*b*, and a radial exterior surface 131*b*. In this example, the radial exterior surface 131*b* includes a profile 134*b* (also called keys 134*b*) that can be secured in corresponding keyholes 136*b* that are formed (for example, machined) in the inner surface of the casing 108. When the keys 134*b* mate with the keyholes 136*b*, the whipstock 126*b* is positioned adjacent and just downhole of the lateral casing window 116*b*. In some aspects, the keys 134*a* of the whipstock 126*a* would not fit into the keyholes 136*b* and, vice versa, the keys 134*b* of the whipstock 126*b* would not fit into the keyholes 136*a*.

As shown in this example, the uphole axial surface 130*b* is angled or slanted from a first edge portion of a top circumference to a second edge portion that is approximately 180° radially apart from the first edge portion (as with the uphole axial surface 130*a* of whipstock 126*a*). Thus, as shown, when the keys 134*b* mate with the keyholes 136*b*, the whipstock 126*b* is positioned such that the uphole axial surface 130*b* is angled downward toward the lateral casing window 116*b* (in other words, the first edge portion is slightly more uphole than the second edge portion).

As shown in FIG. 1, the whipstock 126*b* includes a bore 132*b* (for example, a cylindrical bore) that extends from the uphole axial surface 130*b* to the downhole axial surface 140*b*, thereby creating a flowpath through the whipstock 126*b*. As described in more detail herein, the bore 132*b* can be used as a flowpath for production fluids, a pass through for an intervention tool, or both, as needed. In some aspects, the bore 132*a* of the whipstock 126*a* is larger (for example, in diameter) than the bore 132*b* of the whipstock 126*b*. In alternative aspects, the bore 132*a* of the whipstock 126*a* is substantially the same size (for example, in diameter) as the bore 132*b* of the whipstock 126*b*.

In some aspects, and as shown in this example implementation, the whipstock 126*b* can include one or more magnets 138*b* that are positioned adjacent or near the bore 132*b* in the body 128*b* of the whipstock 126*b*. In some aspects, the magnets 138*b* (which can be permanent magnets, electromagnets, or other type of magnets) can attract a bottom hole assembly of an intervention tool to guide the tool through the bore 132*b* (when running into the wellbore 102 to, for example, the horizontal 118).

In further aspects, and as shown in this example implementation, the whipstock 126*b* can include a sensor 142*b* that is positioned adjacent or near the bore 132*b* in the body 128*b* of the whipstock 126*b*. In some aspects, the sensor 142*b* can detect (and send a signal to terranean surface 104 based on the detection) a presence of a bottom hole assembly of an intervention tool to guide the tool through the bore 132*b* (when running into the wellbore 102 to, for example, the horizontal 118).

In still further aspects, and as shown in this example implementation, the whipstock 126*b* can include one or more magnets 144*a* that are positioned adjacent or near the uphole axial surface 130*a* of the body 128*a* and, more particularly, near an uphole edge (in other words, the first edge portion) of the slanted surface 130*a* and away from the lateral casing window 116*a*. In some aspects, the magnets 144*a* (which can be permanent magnets, electromagnets, or other type of magnets) can attract a bottom hole assembly of an intervention tool to guide the tool through the bore 132*a* (when running into the wellbore 102 to, for example, the lateral 114*b*).

FIG. 1 shows an implementation of the wellbore intervention system 100 in which the whipstocks 126*a* and 126*b* have been installed in the wellbore 102 but prior to an intervention operation being performed in one or more of the laterals 114*a*-114*b* or horizontal 118. In some aspects, FIG. 1 represents the wellbore intervention system 100 in which one, some, or all of the laterals 114*a*-114*b* and horizontal 118 are (or were) producing hydrocarbon (or other) fluids into the wellbore 102, through the production tubing 110, and to the terranean surface. In other aspects, FIG. 1 represents the wellbore intervention system 100 in which none of the laterals 114*a*-114*b* and horizontal 118 are (or have been) producing hydrocarbon (or other) fluids into the wellbore 102, thus necessitating one or more intervention operations. In some aspects, the whipstocks 126*a* and 126*b* are permanent components of the construction of the wellbore intervention system 100 and, once installed in the casing 108, completion components (for example, valves, open hole packers, inflow control devices, tracers) can be installed in the wellbore 102, including the laterals 114*a*-114*b* and the horizontal 118.

Figure 2:
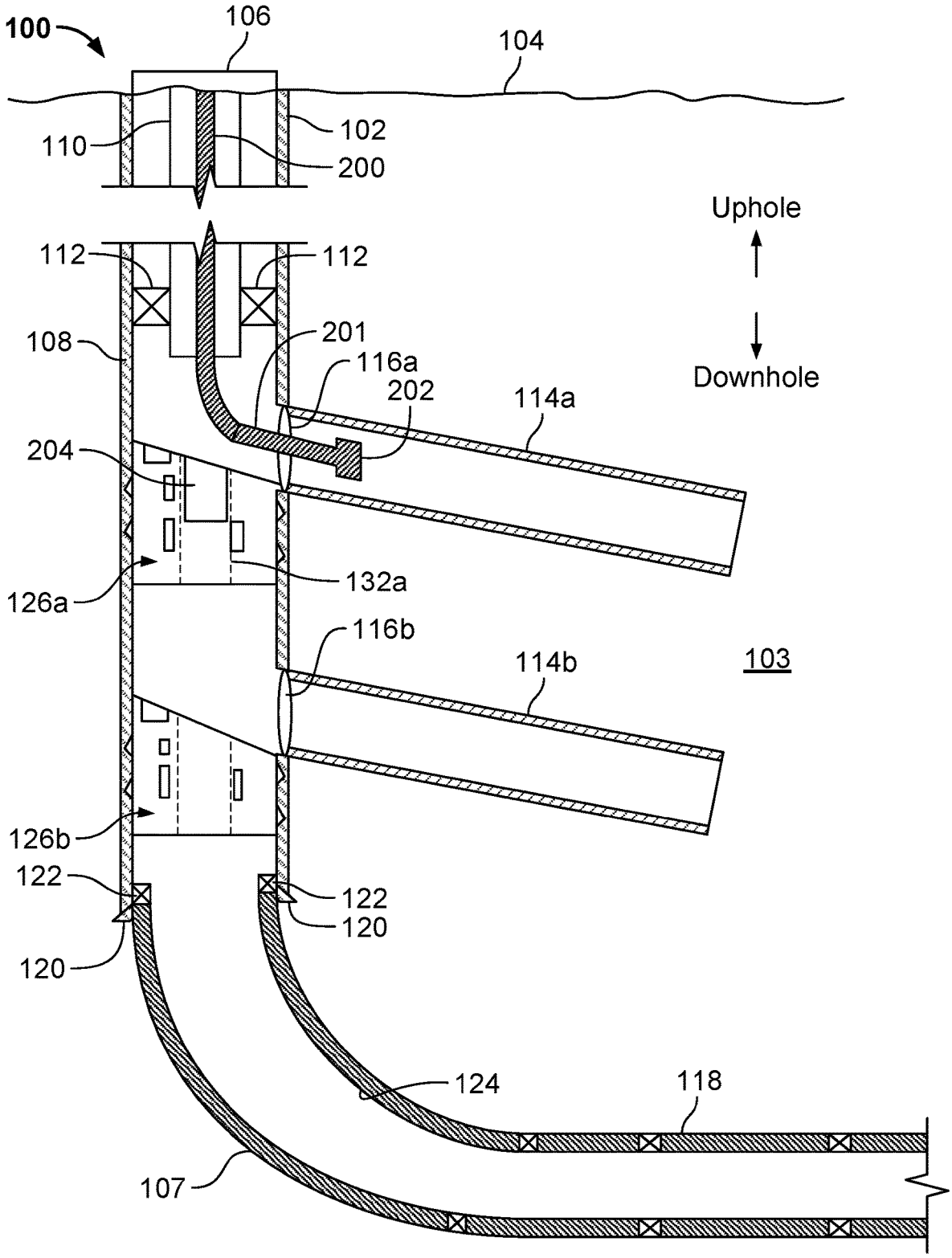

Turning to FIG. 2, this figure illustrates the wellbore intervention system 100 during an intervention operation into the lateral 114*a* by an intervention tool 201 that includes a bottom hole assembly (BHA) 202 mounted on a workstring 200. As shown, the intervention tool 201 can be run into the wellbore 102 and through the production tubing 110 to a location uphole of the whipstock 126*a* (but downhole of the termination of the production tubing 110). In this example, prior to running the intervention tool 201 into the wellbore 102, a retrievable plug 204 can be set (for example, mechanically or otherwise) into the bore 132*a* to seal the bore 132*a*. As shown, in some aspects, a top of the plug 204, once positioned in the bore 132*a*, is angled similarly to the uphole axial surface 130*a* of the body 128*a*. Thus, when positioned in the bore 132*a*, the plug 204 in combination with the uphole axial surface 130*a* creates a solid, angled surface (in other words, with no hole created by the bore 132*a*). In some aspects, complementary profiles on an outer surface of the plug 204 and the inner surface of the body 128*a* that defines the bore 132*a* can ensure that the plug 204 can be positioned correctly to create a flush surface with the uphole axial surface 130*a*. In alternative aspects, the OD of BHA 202 may be bigger that the ID of the bore 132*a*, such that the intervention tool 201 does not enter the bore and is pushed into lateral 114*a*. In this alternative aspect, for example, a plug 204 may not be needed.

When running the intervention tool 201 into the wellbore 102 subsequent to installation of the plug 204 into the bore 132*a*, therefore, the whipstock 126*a* can function as a conventional whipstock and guide the BHA 202 into the lateral 114*a*. For instance, the BHA 202 may contact the uphole axial surface 130*a* (with the plug 204 installed) and slide angularly toward the lateral casing window 116*a* to enter the lateral 114*a* as shown. Intervention operations can then be performed in the lateral 114*a* with the intervention tool 201. Subsequent to the intervention operations within the lateral 114*a*, the intervention tool 201 can be run out of the wellbore 102 and the plug 204 removed (for example, by a wireline or tubing mounted tool) from the bore 132*a*. In some aspects, production of hydrocarbon fluids can then commence (or re-commence) through the bore 132*a*.

Figure 3:
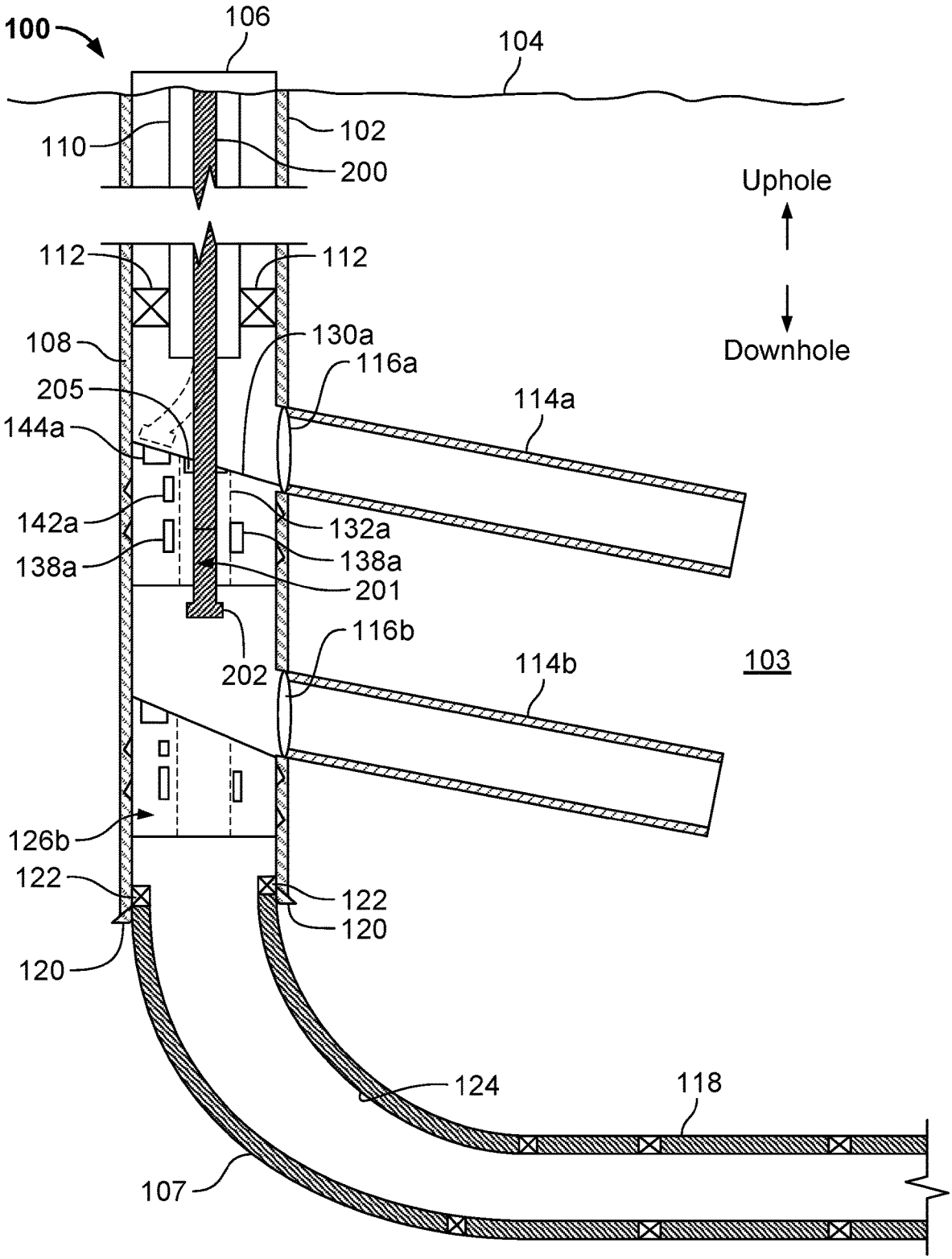

Turning to FIG. 3, this figure illustrates an operation of the wellbore intervention system 100 in which intervention operations may be required in the lateral 114*b* (or horizontal 118). Thus, the intervention tool 201 can pass through the bore 132*a* to reach the lateral 114*b* (or horizontal 118). As shown, the BHA 202 may be sized to fit through the bore 132*a*.

In some aspects, entry of the BHA 202 into the bore 132*a* (at the uphole axial surface 130*a*) can be assisted by one or more features of the whipstock 126*a*. For example, as shown with the dashed line representation of the BHA 202, the one or more magnets 144*a* of the whipstock 126*a* can attract the BHA 202 toward an "uphole edge" of the angled surface of the uphole axial surface 130*a*. As further weight is put on the intervention tool 201 (for example, by the workstring 200), the BHA 202 can slide away from the uphole edge (and the one or more magnets 144*a*) and into the bore 132*a*.

As another example component that can be used in addition or alternatively to the one or more magnets 144*a*, an entry guide 205 can first be installed in the bore 132*a*. In some aspects, the entry guide 205 can include a cone or funnel shape entry to guide (or help guide) the BHA 202 into the bore 132*a*.

In some aspects, once the BHA 202 has entered the bore 132*a* (or to help guide the BHA 202 into the bore 132*a*), the one or more magnets 138*a* positioned adjacent the bore 132*a* can attract the BHA 202. In some aspects, the magnet(s) 138*a* can pull or help pull the BHA 202 (and intervention tool 201) into and through the bore 132*a*.

In some aspects, as the BHA 202 passes through the bore 132*a*, the sensor 142*a* can detect a presence of the BHA 202 (for example, magnetically, electrically, or otherwise). The detected presence of the BHA 202 passing through the bore 132*a* can be transmitted (wired or wirelessly) from the sensor 142*a* to the terranean surface 104.

Figure 4:
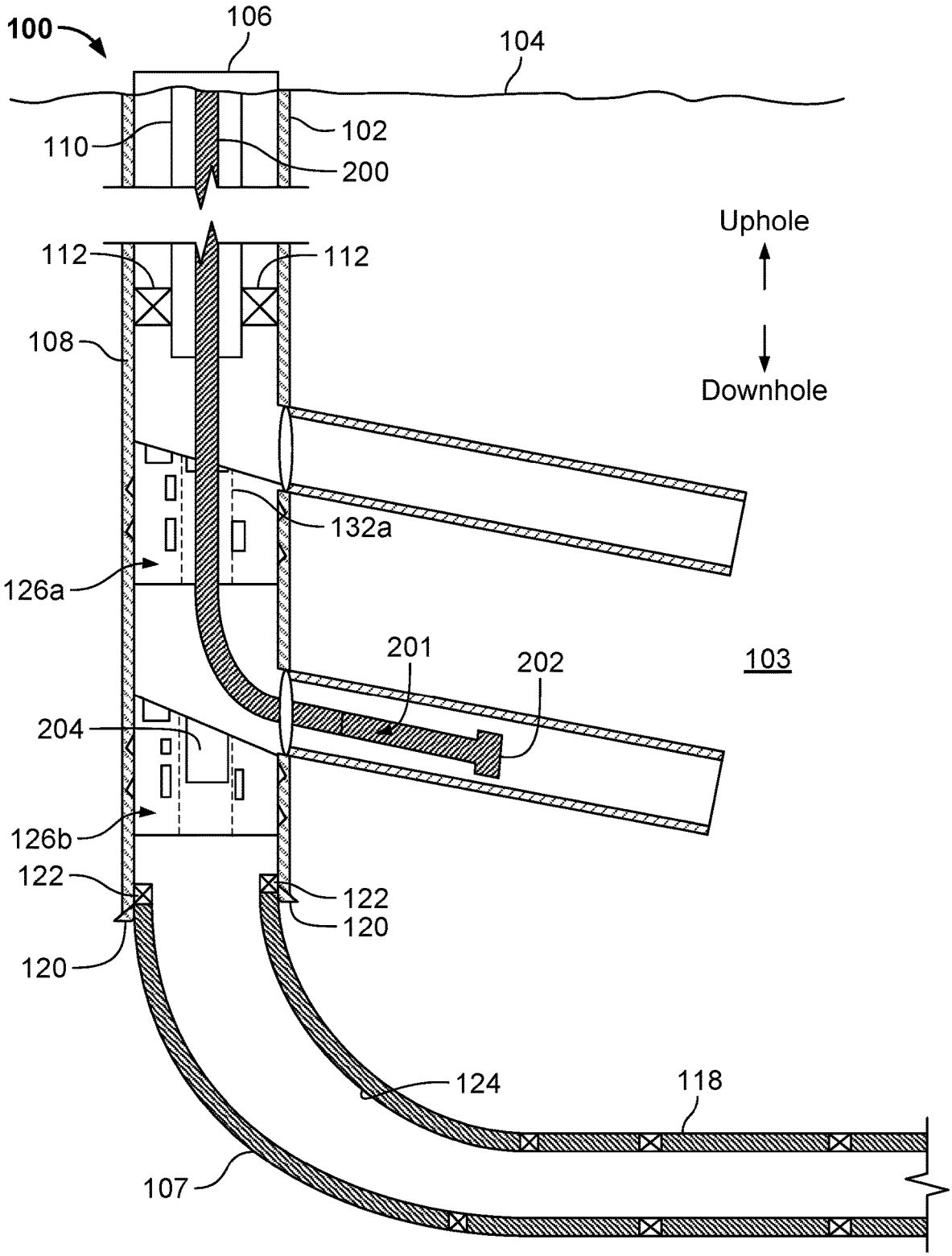

Turning to FIG. 4, this figure illustrates the wellbore intervention system 100 during an intervention operation into the lateral 114*b* by the intervention tool 201 and BHA 202 subsequent to passing through the bore 132*a* of the whipstock 126*a*. In this example, prior to running the intervention tool 201 into the wellbore 102, another retrievable plug 204 can be set (for example, mechanically or otherwise) into the bore 132*b* to seal the bore 132*b*. In some aspects, this operation can be performed with the BHA 202. In an alternate aspect, the OD of BHA 202 may be bigger than the ID of the bore 132*b* and smaller than the bore 132*a*, such that the intervention tool 201 will pass through upper whipstock 126*a* but not enter the bore of 126*b* and, instead, can be pushed into lateral 114*b*. This alternative aspect may not require the plug 204 to be installed in whipstock 126*b*.

As shown, in some aspects, a top of the plug 204, once positioned in the bore 132*b*, is angled similarly to the uphole axial surface 130*b* of the body 128*b*. Thus, when positioned in the bore 132*b*, the plug 204 in combination with the uphole axial surface 130*b* creates a solid, angled surface (in other words, with no hole created by the bore 132*b*). In some aspects, complementary profiles on an outer surface of the plug 204 and the inner surface of the body 128*b* that defines the bore 132*b* can ensure that the plug 204 can be positioned correctly to create a flush surface with the uphole axial surface 130*b*.

When running the intervention tool 201 into the wellbore 102 subsequent to installation of the plug 204 into the bore 132*b*, therefore, the whipstock 126*a* can function as a conventional whipstock and guide the BHA 202 into the lateral 114*b*. For instance, the BHA 202 may contact the uphole axial surface 130*b* (with the plug 204 installed) and slide angularly toward the lateral casing window 116*b* to enter the lateral 114*b* as shown. Intervention operations can then be performed in the lateral 114*b* with the intervention tool 201. Subsequent to the intervention operations within the lateral 114*b*, the intervention tool 201 can be run out of the wellbore 102 and the plug 204 removed (for example, by a wireline or tubing mounted tool) from the bore 132*b*. In some aspects, production of hydrocarbon fluids can then commence (or re-commence) through the bore 132*b*.

Figure 5:
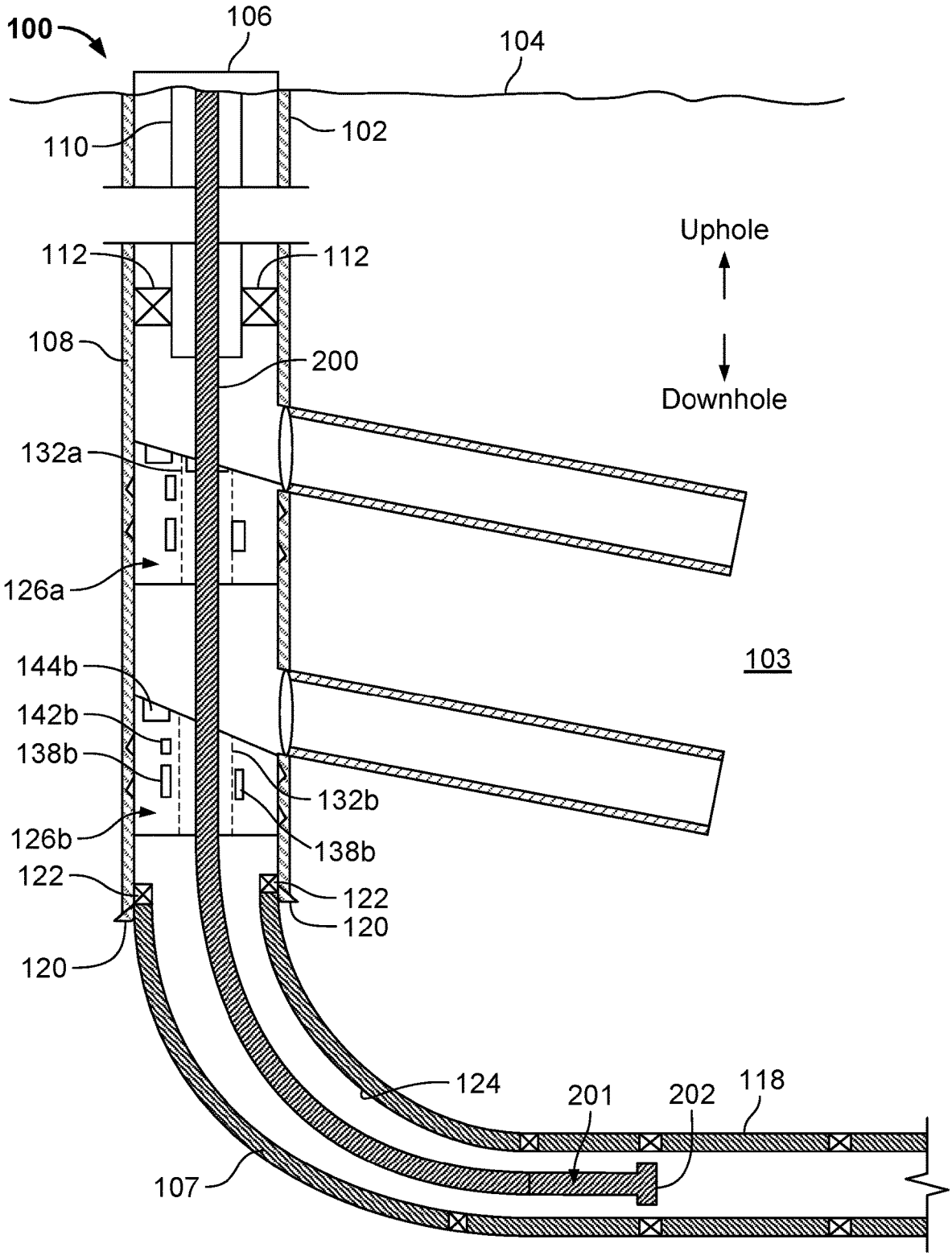

Turning to FIG. 5, this figure illustrates an operation of the wellbore intervention system 100 in which intervention operations may be required in the horizontal 118. Thus, the intervention tool 201 can pass through the bores 132*a* and 132*b* to reach the horizontal 118. As shown, the BHA 202 may be sized to fit through the bores 132*a* and 132*b* (whether they are the same or different diameters).

In some aspects, entry of the BHA 202 into the bore 132*b* (at the uphole axial surface 130*b*) can be assisted by one or more features of the whipstock 126*b*, similarly to the operation described in FIG. 3 for the whipstock 126*a*. For example, the one or more magnets 144*b* of the whipstock 126*b* can attract the BHA 202 toward an "uphole edge" of the angled surface of the uphole axial surface 130*b*. As further weight is put on the intervention tool 201 (for example, by the workstring 200), the BHA 202 can slide away from the uphole edge (and the one or more magnets 144*b*) and into the bore 132*b*.

As another example component that can be used in addition or alternatively to the one or more magnets 144*a*, an entry guide (such as entry guide 205) can first be installed in the bore 132*b*. In some aspects, the entry guide 205 can include a cone or funnel shape entry to guide (or help guide) the BHA 202 into the bore 132*b*.

In some aspects, once the BHA 202 has entered the bore 132*b* (or to help guide the BHA 202 into the bore 132*b*), the one or more magnets 138*b* positioned adjacent the bore 132*b* can attract the BHA 202. In some aspects, the magnet(s) 138*b* can pull or help pull the BHA 202 (and intervention tool 201) into and through the bore 132*b*.

In some aspects, as the BHA 202 passes through the bore 132*b*, the sensor 142*b* can detect a presence of the BHA 202 (for example, magnetically, electrically, or otherwise). The detected presence of the BHA 202 passing through the bore 132*b* can be transmitted (wired or wirelessly) from the sensor 142*b* to the terranean surface 104.

Subsequent to the intervention operations within the horizontal 118, the intervention tool 201 can be run out of the wellbore 102 (and back through bores 132*b* and 132*a*). In some aspects, production of hydrocarbon fluids can then commence (or re-commence) through the bores 132*b* and 132*a* from one, some, or all of the laterals 114*a*-114*b* and horizontal 118.

FIGS. 6A-6D show an example implementation of a scope head 600 that can be used with a whipstock, such as one or both of the whipstocks 126*a* and 126*b*. In this example implementation, the scope head 600 is comprised of two or more scope arms 605 that are positioned on an uphole end of a body 601 of the scope head 600 through a bore 610 extends. In this example, the bore 610 extends from at or near an uphole opening 620 (that is adjustable by the arms 605) to a downhole opening 615. The scope head 600, generally, can be run into a wellbore and positioned within at least a portion of a bore of a whipstock according to the present disclosure to selectively allow access through the bore (when the scope head 600 is in an open position) or deny access through the bore (when the scope head 600 is in a closed position).

Figure 6A:
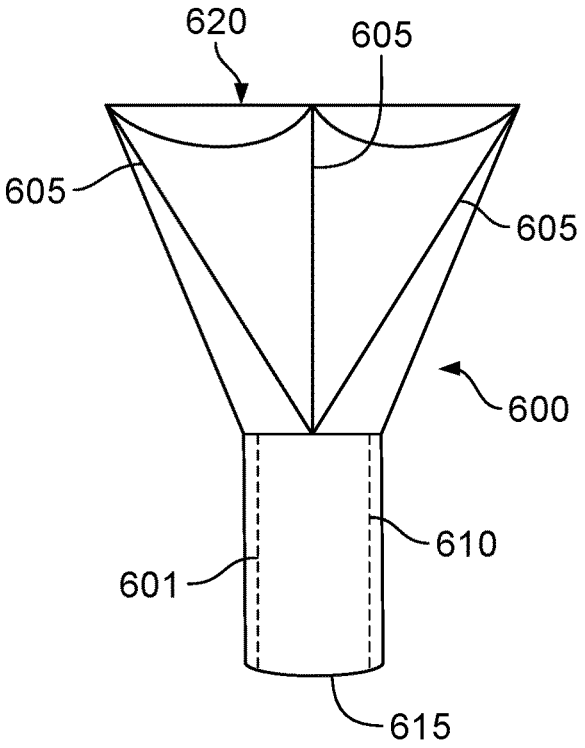
FIGS. 6A-6D show an example implementation of a scope head that can be used with a whipstock according to the present disclosure.
Figure 6B:
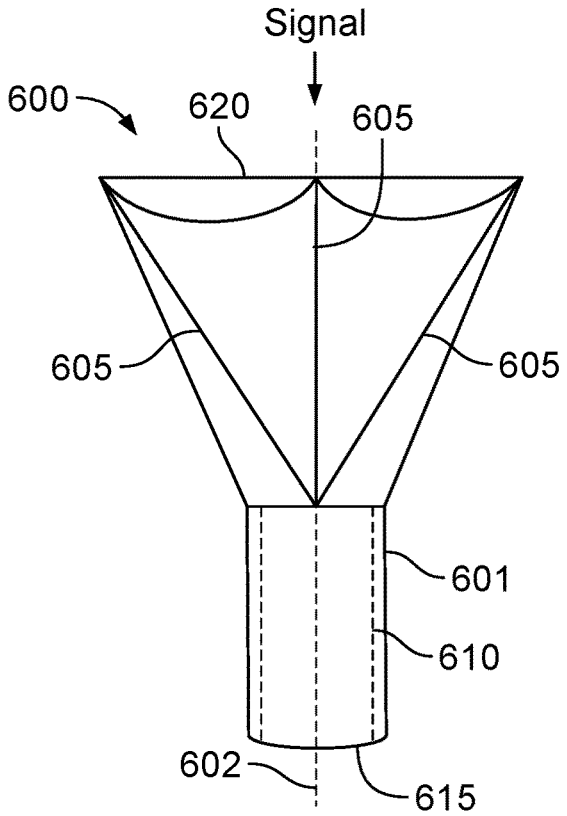

FIGS. 6A-6B show the example implementation of the scope head 600 in an open position. In the open position, the arms 605 can be extended away from a centerline axis 602 of the scope head 600 to fluidly connect the uphole opening 602 with the bore 610 and with the downhole opening 615. By fluidly connecting the uphole opening 602 with the bore 610 and with the downhole opening 615, fluids or intervention tools can pass through the bore 610 of the scope head 600.

Figure 6C:
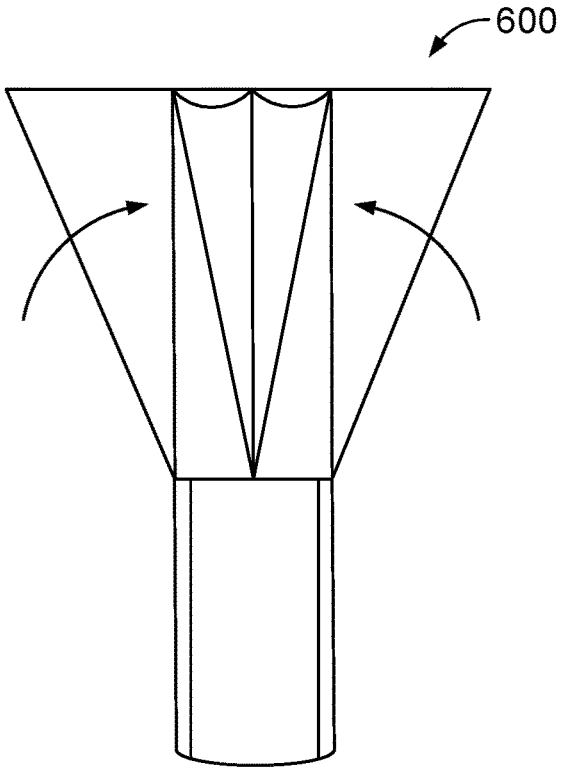

FIG. 6C shows the example implementation of the scope head 600 as it adjusts from the open position to a closed position. For example, a signal (wired or wireless) from the terranean surface can be provided to the scope head 600 to adjust the scope head 600 from the open position to a closed position and, vice versa, from the open position to a closed position. As shown in FIG. 6C, the signal can operate to adjust the arms 605 toward the centerline axis 602 of the scope head 600 to reduce a size of the uphole opening 620.

Figure 6D:
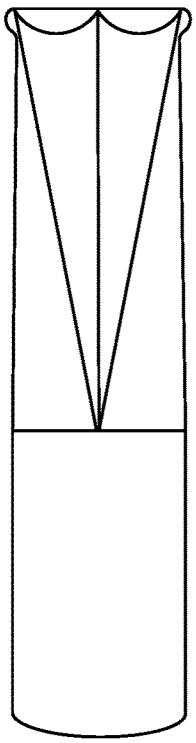

FIG. 6D shows the example implementation of the scope head 600 in the closed position. In the closed position, the arms 605 are moved toward the centerline axis 602 of the scope head 600 to fluidly disconnect the uphole opening 602 with the bore 610 and with the downhole opening 615 (for example, by closing the uphole opening 620). By fluidly disconnecting the uphole opening 602 with the bore 610 and with the downhole opening 615, fluids or intervention tools cannot pass through the bore 610 of the scope head 600.

Figure 6E:
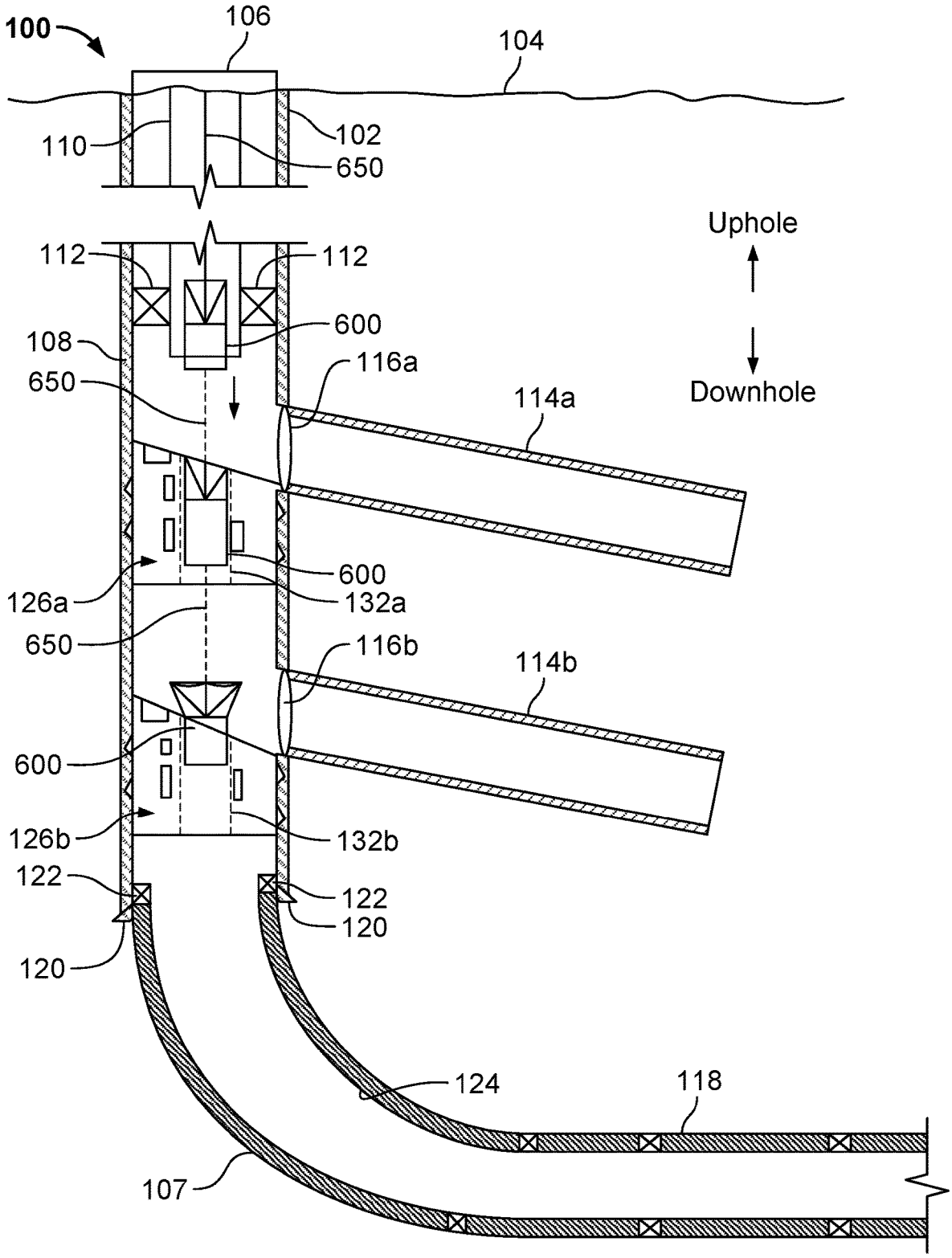
FIG. 6E shows an example implementation of an operation performed with a wellbore intervention system that includes one or more whipstocks and a scope head according to the present disclosure.

FIG. 6E shows an example implementation of an operation performed with the wellbore intervention system 100 that includes one or more whipstocks 126*a*-126*b* and the scope head 600. This figure shows movement of the scope head 600 downhole through the wellbore 102 and, more specifically, through the production tubular 110, the whipstock 126*a*, and into the whipstock 126*b*. For example, as shown, the scope head 600 can be run into the wellbore on a downhole conveyance 650 (such as a wireline or other conveyance). As the scope head 600 passes through the production tubular 110, it can be in the closed position. In this example, the scope head 600 also remains in the closed position as it passes through the bore 132*a* of the whipstock 126*a* (on the downhole conveyance 650, shown in dashed line between the production tubular 110 and the whipstock 126*a*. In this example, the scope head 600 then is run into the bore 132*b* of the whipstock 126*b* where it can be adjusted to the open position (for example, by a signal through the downhole conveyance 650). Thus, in this figure, the scope head 600 can allow an intervention tool to pass through the bore 132*b* and into the horizontal 118. Alternatively, the scope head 600 can be positioned in the bore 132*b* and adjusted to (or remain in) the closed position to force an intervention tool to enter the lateral 114*b*. As another example, the scope head 600 can be positioned in the bore 132*a* and adjusted to (or remain in) the closed position to force an intervention tool to enter the lateral 114*a*.

In some aspects, use of the scope head 600 can replace, for example, a retrievable plug that can be positioned in one or both of the bores 132*a*-132*b* of the respective whipstocks 126*a*-126*b*. Further, in some aspects, the scope head 600 can be used in implementations of the wellbore intervention system 100 in which the bores 132*a* and 132*b* are the same or approximately the same size (for example, same diameter).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A wellbore intervention system, comprising:

a first whipstock configured to run into a wellbore formed from a terranean surface to one or more subterranean formations, the first whipstock comprising:

a first bore of a first diameter that extends from an uphole, angled face of the first whipstock to a downhole face of the first whipstock, and one or more first keys formed on a radial exterior surface of the first whipstock and configured to secure into one or more first keyholes formed in a casing that is secured in the wellbore to position the first whipstock adjacent a first lateral formed from a first lateral window in the casing;

a second whipstock configured to run into the wellbore formed from the terranean surface to the one or more subterranean formations, the second whipstock comprising:

a second bore of a second diameter that extends from an uphole, angled face of the second whipstock to a downhole face of the second whipstock, where the first diameter is the same or substantially the same as the second diameter, and one or more second keys formed on a radial exterior surface of the second whipstock and configured to secure into one or more second keyholes formed in the casing to position the second whipstock adjacent a second lateral formed from a second lateral window in the casing;

an intervention tool configured to selectively pass through one or both of the first or second bores and enter at least one of the first lateral, the second lateral, or another lateral downhole of the first and second laterals; and an adjustable entry tool configured to adjust between a closed position to pass into the first bore and prevent passage of the intervention tool through the first bore, and an open position, based on a signal from the terranean surface, to allow passage of the intervention tool through the first bore while the entry tool is positioned in the first bore.

2. The wellbore intervention system of claim 1, wherein the one or more first keys comprise a first geometric configuration unique to the one or more first keyholes, and the one or more second keys comprise a second geometric configuration unique to the one or more second keyholes.

3. The wellbore intervention system of claim 2, wherein the intervention tool is configured to perform one or more well intervention operations in the first lateral, the second lateral, or the another lateral downhole of the first and second laterals after passing through at least one of the first or second bores.

4. The wellbore intervention system of claim 1, wherein the first diameter is less than the second diameter, and the second lateral window is uphole of the first lateral window.

5. The wellbore intervention system of claim 1, wherein the one or more first keys are positioned on the first whipstock to engage the one or more first keyholes to orient the uphole, angled face of the first whipstock angularly downward toward the first lateral window, and the one or more second keys are positioned on the second whipstock to engage the one or more second keyholes to orient the uphole, angled face of the second whipstock angularly downward toward the second lateral window.

6. The wellbore intervention system of claim 1, further comprising:

a retrievable plug configured to position within at least a portion of the first bore and flush with the uphole, angled face of the first whipstock to fluidly separate a portion of the wellbore uphole of the first whipstock from a portion of the wellbore downhole of the first whipstock.

7. The wellbore intervention system of claim 1, further comprising:

a retrievable entry guide configured to position within at least a portion of the first bore, the guide comprising a funnel or conical shape to guide a bottom hole assembly of the intervention tool into the first bore.

8. The wellbore intervention system of claim 1, wherein the first whipstock further comprises one or more magnets positioned at or adjacent the uphole, angled face of the first whipstock, the one or more magnets configured to attract a bottom hole assembly of the intervention tool toward an uphole side of the uphole, angled face of the first whipstock such that the bottom hole assembly of the intervention tool can slide into the first bore from the uphole side of the uphole, angled face of the first whipstock based on a setting down weight of a workstring on the intervention tool.

9. The wellbore intervention system of claim 1, wherein the first whipstock further comprises one or more magnets positioned within a body of the first whipstock adjacent or near the first bore, the one or more magnets configured to attract a bottom hole assembly of the intervention tool toward and through the first bore.

10. The wellbore intervention system of claim 1, wherein the first whipstock further comprises at least one sensor configured to detect the intervention tool passing through the first bore.

11. The wellbore intervention system of claim 1, wherein the intervention tool is configured to perform one or more well intervention operations in the first lateral, the second lateral, or the another lateral downhole of the first and second laterals after passing through at least one of the first or second bores.

12. A well intervention method, comprising:

running a first whipstock into a wellbore formed from a terranean surface to one or more subterranean formations, the first whipstock comprising a first bore of a first diameter that extends from an uphole, angled face of the first whipstock to a downhole face of the first whipstock;

securing the first whipstock into a casing installed in the wellbore by securing one or more first keys formed on a radial exterior surface of the first whipstock into one or more first keyholes formed in the casing;

based on the securing, positioning the first whipstock adjacent a first lateral formed from a first lateral window in the casing;

running a second whipstock into the wellbore, the second whipstock comprising a second bore of a second diameter that extends from an uphole, angled face of the second whipstock to a downhole face of the second whipstock, where the first diameter is the same or substantially the same as the second diameter;

securing the second whipstock into the casing by securing one or more second keys formed on a radial exterior surface of the second whipstock into one or more second keyholes formed in the casing;

based on the securing, positioning the second whipstock adjacent a second lateral formed from a second lateral window in the casing; and running an adjustable entry tool into the wellbore in a closed position;

positioning the adjustable entry tool in the first bore;

adjusting the adjustable entry tool from the closed position to an open position;

running an intervention tool through the first bore and into the second lateral through the second lateral window;

selectively passing the intervention tool run into the wellbore through one or both of the first or second bores; and running the intervention tool into at least one of the first lateral, the second lateral, or another lateral downhole of the first and second laterals subsequent to selectively passing the intervention tool through the one or both of the first or second bores.

13. The method of claim 12, wherein the one or more first keys comprise a first geometric configuration unique to the one or more first keyholes, and the one or more second keys comprise a second geometric configuration unique to the one or more second keyholes.

14. The method of claim 13, further comprising performing one or more well intervention operations in the first lateral, the second lateral, or the another lateral downhole of the first and second laterals with the intervention tool after passing through at least one of the first or second bores.

15. The method of claim 12, wherein the first diameter is larger than the second diameter, and the second lateral window is downhole of the first lateral window.

16. The method of claim 12, further comprising:

engaging the one or more first keys with the one or more first keyholes to orient the uphole, angled face of the first whipstock angularly downward toward the first lateral window; and engaging the one or more second keys with the one or more second keyholes to orient the uphole, angled face of the second whipstock angularly downward toward the first lateral window.

17. The method of claim 12, further comprising:

positioning a retrievable plug within at least a portion of the first bore and flush with the uphole, angled face of the first whipstock;

fluidly separating a portion of the wellbore uphole of the first whipstock from a portion of the wellbore downhole of the first whipstock through the first bore with the retrievable plug positioned within the portion of the first bore; and subsequent to positioning the retrievable plug, running the intervention tool into the first lateral from the first lateral window.

18. The method of claim 12, further comprising:

positioning a retrievable entry guide within at least a portion of the first bore; and guiding, with the retrievable entry guide positioned in the portion of the first bore, a bottom hole assembly of the intervention tool into the first bore.

19. The method of claim 12, further comprising:

attracting a bottom hole assembly of the intervention tool toward an uphole side of the uphole, angled face of the first whipstock with one or more magnets positioned at or adjacent the uphole, angled face of the first whipstock;

setting down weight on the intervention tool with a workstring; and based on the weight, sliding the intervention tool into the first bore from an uphole side of the uphole, angled face of the first whipstock.

20. The method of claim 12, further comprising:

attracting a bottom hole assembly of the intervention tool toward and through the first bore with one or more magnets positioned within a body of the first whipstock adjacent or near the first bore.

21. The method of claim 12, further comprising detecting the intervention tool passing through the first bore of the first whipstock with at least one sensor positioned in the first whipstock.

22. The method of claim 12, further comprising performing one or more well intervention operations in the first lateral, the second lateral, or the another lateral downhole of the first and second laterals with the intervention tool after passing through at least one of the first or second bores.

23. A wellbore whipstock tool assembly, comprising:

a body that comprises:

an uphole axial surface that is slanted from one portion of an edge of the uphole axial surface to another portion of the edge of the uphole axial surface, a downhole axial surface opposite the uphole axial surface, and a radial surface between the uphole axial surface and the downhole axial surface;

one or more keys formed on the radial surface and configured to secure into one or more keyholes formed in a casing of a wellbore;

a bore that extends between an opening in the uphole axial surface and an opening in the downhole axial surface, the bore sized to receive a bottom hole assembly of an intervention tool; and an adjustable entry tool configured to adjust between a closed position to pass into the bore and prevent passage of an intervention tool through the bore, and an open position, based on a signal from the terranean surface, to allow passage of the intervention tool through the bore while the entry tool is positioned in the bore.

24. The wellbore whipstock tool assembly of claim 23, wherein the one or more keys are configured to uniquely fit within the one or more keyholes.

25. The wellbore whipstock tool assembly of claim 23, wherein the one or more keys are positioned on the radial surface to engage the one or more keyholes to orient the body such that the portion of the edge of the uphole axial surface is uphole of the another portion of the edge of the uphole axial surface, and the another portion of the edge of the uphole axial surface is adjacent to a lateral window of the casing.

26. The wellbore whipstock tool assembly of claim 23, further comprising:

a retrievable plug configured to position within at least a portion of the bore and flush with the uphole axial surface.

27. The wellbore whipstock tool assembly of claim 23, further comprising:

a retrievable entry guide configured to position within at least a portion of the bore, the guide comprising a funnel or conical shape to guide a bottom hole assembly of the intervention tool into the bore.

28. The wellbore whipstock tool assembly of claim 23, further comprising one or more magnets positioned at or adjacent the uphole axial surface of the body, the one or more magnets configured to attract a bottom hole assembly of the intervention tool toward the portion of the edge of the uphole axial surface.

29. The wellbore whipstock tool assembly of claim 23, further comprising one or more magnets positioned within the body adjacent or near the bore, the one or more magnets configured to attract a bottom hole assembly of the intervention tool toward and through the bore.

30. The wellbore whipstock tool assembly of claim 23, further comprising at least one sensor positioned in the body and configured to detect the intervention tool passing through the bore.

* * * * *